US012241348B2

(12) United States Patent
Westerkamp et al.

(10) Patent No.: US 12,241,348 B2
(45) Date of Patent: Mar. 4, 2025

(54) ARTIFICIAL LIFT SYSTEM WITH UNDER PUMPING MITIGATION

(71) Applicants: Peter Westerkamp, Friendswood, TX (US); Doneil M Dorado, Missouri City, TX (US); Eric S Oestreich, Sugarland, TX (US)

(72) Inventors: Peter Westerkamp, Friendswood, TX (US); Doneil M Dorado, Missouri City, TX (US); Eric S Oestreich, Sugarland, TX (US)

(73) Assignee: Ravdos Holdings, Inc., Missouri City, TX (US)

( * ) Notice: Subject to any disclaimer, the term of this patent is extended or adjusted under 35 U.S.C. 154(b) by 0 days.

(21) Appl. No.: 18/302,348

(22) Filed: Apr. 18, 2023

(65) Prior Publication Data

US 2023/0340864 A1 Oct. 26, 2023

Related U.S. Application Data

(60) Provisional application No. 63/363,158, filed on Apr. 18, 2022.

(51) Int. Cl.

| | |
|---|---|
| ***E21B 47/009*** | (2012.01) |
| ***E21B 43/12*** | (2006.01) |
| ***F04B 47/02*** | (2006.01) |
| ***F04B 49/20*** | (2006.01) |

(52) U.S. Cl.

CPC ..... *E21B 43/127* (2013.01); *E21B 47/009* (2020.05); *F04B 47/026* (2013.01); *F04B 49/20* (2013.01)

(58) Field of Classification Search

CPC .... E21B 43/127; E21B 47/009; F04B 47/026; F04B 49/20

See application file for complete search history.

(56) References Cited

U.S. PATENT DOCUMENTS

| | | | | |
|---|---|---|---|---|
| 4,125,163 | A * | 11/1978 | Fitzpatrick | G05D 9/12 166/250.03 |
| 4,744,729 | A * | 5/1988 | Hasten | G05D 9/12 417/18 |
| 2009/0055029 | A1* | 2/2009 | Roberson | G05B 23/0267 700/282 |
| 2012/0283950 | A1* | 11/2012 | Anderson | G01F 23/22 702/6 |
| 2014/0262245 | A1* | 9/2014 | Hill | E21B 47/047 166/250.03 |
| 2017/0037845 | A1* | 2/2017 | Al Assad | F04B 49/065 |
| 2017/0268500 | A1* | 9/2017 | Al Assad | F04B 49/065 |
| 2018/0038366 | A1* | 2/2018 | Sobin | F04B 53/14 |
| 2022/0356801 | A1* | 11/2022 | Schaupp | G01F 23/14 |
| 2022/0381120 | A1* | 12/2022 | Nimbalkar | E21B 47/008 |
| 2023/0272793 | A1* | 8/2023 | Redmond | F04B 51/00 417/53 |

* cited by examiner

*Primary Examiner* — Taras P Bemko

(57) ABSTRACT

An artificial lift system provides an under pumping mitigation functionality through the use of a controller that adjusts a sucker rod pump's pumping speed. The controller determines whether: (a) the fillage level of the pump is equal to or above a pre-determined fillage level. The controller also determines whether the fluid level in the wellbore in which the pump is positioned is not decreasing. and increases the pumping rate of the pump if, over a given period, both (i) the fluid level is not decreasing and (ii) the pump fillage level is above the predetermined fillage level.

18 Claims, 7 Drawing Sheets

ARTIFICIAL LIFT SYSTEM WITH UNDER PUMPING MITIGATION

CROSS REFERENCE TO RELATED APPLICATIONS

This application claims the benefit of U.S. Provisional Application No. 63/363,158, filed on Apr. 18, 2022, which is hereby incorporated by reference.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

The present inventions relate to artificial lift systems and more specifically to artificial lift systems that include a rod pump assembly of the type designed to be stroked upwards and downwards within a wellbore, where the operating speed of the rod pump is variable.

For a variety of reasons, including the desirability of optimizing equipment life, sucker rod pumps are commonly operated at, or below, a predetermined a maximum operating speed.

While limiting the maximum operating speed can provide overall system benefits (e.g., in terms of avoiding undesired wear of, or stress on, system components), it can also result in instances where the operating rate of the pump is not correlated with the rate of production from the reservoir. Such a situation can involve a state (or incidences) of under pumping. Under pumping can give rise to a number of undesired results including reduced production rates, increased water cut, equipment damage, increased operating costs, and wellbore damage.

Detection of an under pumping can be challenging. Such a state is not clearly associated with available surface measurements. As such, it is conventional to seek to avoid the under pumping state by selecting the maximum operating rate of the pump such that under pumping conditions are unlikely to occur. However, such setting of the maximum operating rate of the pump can result in the operation of the pump that create undesired wear of pump components or undesired underfill pump situations.

The present disclosure describes system and methods for beneficially detecting and mitigating under pumping conditions in a manner that can provide overall system performance benefits without introducing significant undesirable operating attributes into the system.

It is to be understood that the discussion above is provided for illustrative purposes only and is not intended to and does not limit the scope or subject matter of the appended or ultimately issued claims or those of any related patent application or patent. Thus, none of the appended claims, ultimately issued claims or claims of any related application or patent are to be limited by the above discussion or construed to address, include, or exclude each or any of the above-cited features or disadvantages merely because such were mentioned herein.

BRIEF SUMMARY OF THE INVENTION

A brief non-limiting summary of one of the many possible embodiments of the inventions disclosed herein is an artificial lift system with under pumping mitigation comprising: a sucker rod pump connected to a sucker rod, the sucker rod pump being positioned so that it may be stroked downwards and upwards within an annulus; a beam pumping assembly, the beam pumping assembly including a crank, the crank being coupled to the sucker rod; a variable speed motor connected to drive the crank of the beam pumping assembly; a variable speed drive configured to excite the variable speed motor in such a manner that the rotational speed of the motor, and thus, the pumping speed of the beam pumping assembly is varied; a controller configured to: determine the fillage level of the pump; determine whether the fillage level of the pump is equal to or above a pre-determined fillage level; in the event that the fillage level of the pump is determined to be equal to or above the determined fill level, determine whether the fluid level in the annulus is decreasing; in the event that the fluid level in annulus is determined to be not decreasing, determine whether the determined conditions of: (a) a pump fillage level equal to or above the predetermined fillage level and (b) fluid level in the annulus that is not decreasing have co-existed for a period in excess of a predetermined duration; and in the event that the conditions of: (a) a pump fillage level equal to or above the predetermined fillage level and (b) fluid level in the annulus that is not decreasing have co-existed for a period in excess of the predetermined duration, controlling the variable speed drive to increase the speed of variable speed motor and, thus, the pumping rate of the sucker rod pump.

Additionally or alternately, the artificial lift system may further include a sensor for providing an output signal corresponding to the pump inlet pressure, wherein output signal is provided to the controller, and where the controller determines whether the fluid level in the annulus is decreasing by comparing a current running average of pump inlet pressure with a prior running average of the pump inlet pressure.

None of these brief summaries of the inventions is intended to limit or otherwise affect the scope of what has been disclosed and enabled or the appended claims, and nothing stated in this Brief Summary of the Invention is intended as a definition of a claim term or phrase or as a disavowal or disclaimer of claim scope.

Figure 1:
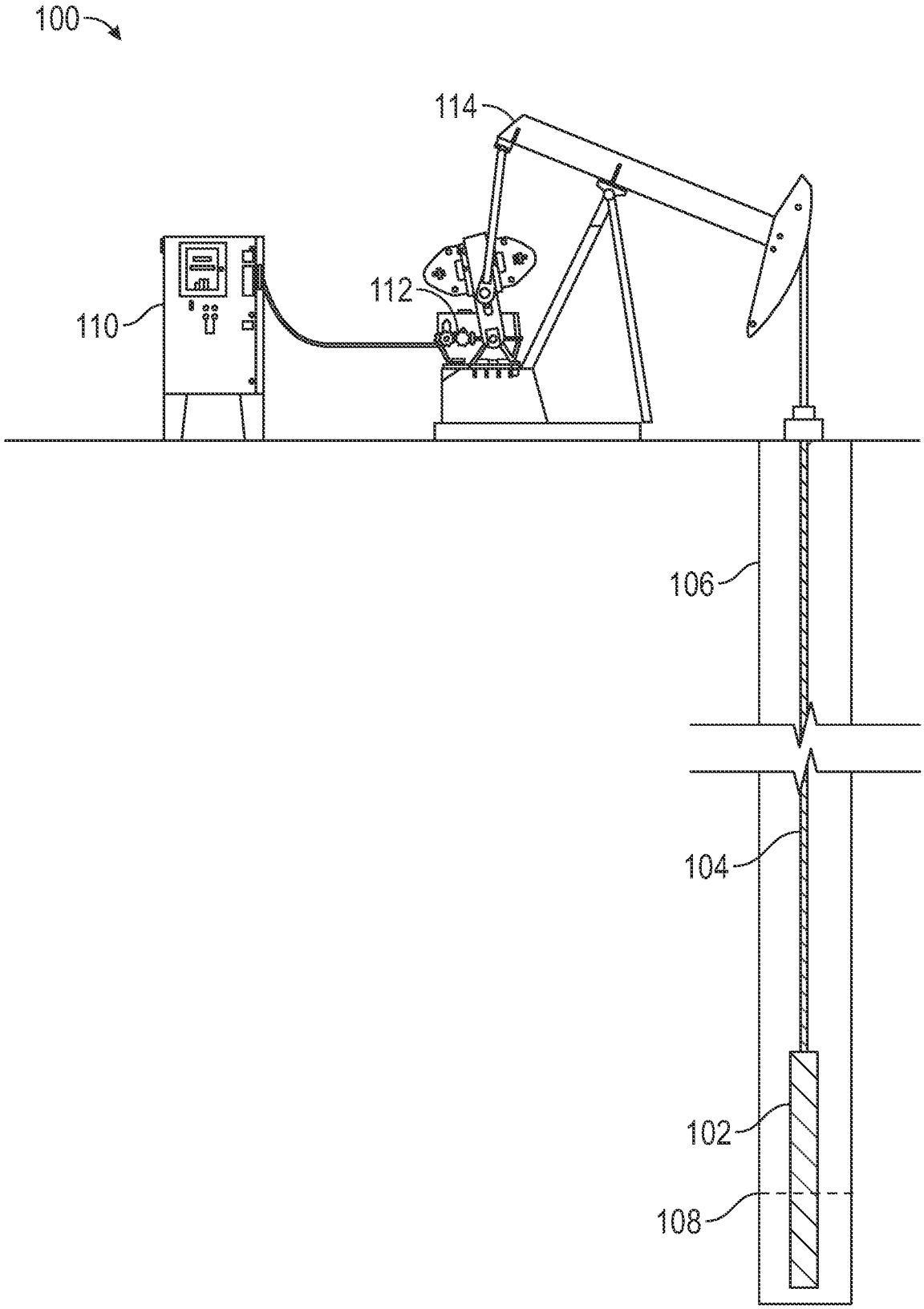
FIG. 1 illustrates one exemplary embodiment of an artificial lift system 100 with under pumping mitigation.

While the inventions disclosed herein are susceptible to various modifications and alternative forms, only a few specific embodiments have been shown by way of example in the drawings and are described in more detail below. The figures and detailed descriptions of these embodiments are not intended to limit the breadth or scope of the inventive concepts or the appended claims in any manner. Rather, the figures and detailed written descriptions are provided to illustrate the inventive concepts to a person of ordinary skill in the art and to enable such person to make and use the inventive concepts illustrated and taught by the specific embodiments.

DETAILED DESCRIPTION

The Figures described above, and the written description of specific structures and functions below, are not presented to limit the scope of what we have invented or the scope of the appended claims. Rather, the Figures and written description are provided to teach any person skilled in this art to make and use the inventions for which patent protection is sought.

A person of skill in this art having benefit of this disclosure will understand that the inventions are disclosed and taught herein by reference to specific embodiments, and that these specific embodiments are susceptible to numerous and various modifications and alternative forms without departing from the inventions we possess. For example, and not limitation, a person of skill in this art having benefit of this disclosure will understand that Figures and/or embodiments that use one or more common structures or elements, such as a structure or an element identified by a common reference number, are linked together for all purposes of supporting and enabling our inventions, and that such individual Figures or embodiments are not disparate disclosures. A person of skill in this art having benefit of this disclosure immediately will recognize and understand the various other embodiments of our inventions having one or more of the structures or elements illustrated and/or described in the various linked embodiments. In other words, not all possible embodiments of our inventions are described or illustrated in this application, and one or more of the claims to our inventions may not be directed to a specific, disclosed example. Nonetheless, a person of skill in this art having the benefit of this disclosure will understand that the claims are fully supported by the entirety of this disclosure.

Those persons skilled in this art will appreciate that not all features of a commercial embodiment of the inventions are described or shown for the sake of clarity and understanding. Persons of skill in this art will also appreciate that the development of an actual commercial embodiment incorporating aspects of the present inventions will require numerous implementation-specific decisions to achieve the developer's ultimate goal for the commercial embodiment. Such implementation-specific decisions may include, and likely are not limited to, compliance with system-related, business-related, government-related, and other constraints, which may vary by specific implementation, location and from time to time. While a developer's efforts might be complex and time-consuming in an absolute sense, such efforts would be, nevertheless, a routine undertaking for those of skill in this art having benefit of this disclosure.

Further, the use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the scope of what is claimed.

Aspects of the inventions disclosed herein may be embodied as an apparatus, system, method, or computer program product. Accordingly, specific embodiments may take the form of an entirely hardware embodiment, an entirely software embodiment or an embodiment combining software and hardware aspects, such as a "circuit," "module" or "system." Furthermore, embodiments of the present inventions may take the form of a computer program product embodied in one or more computer readable storage media having computer readable program code.

When implementing one or more of the inventions disclosed herein, any combination of one or more computer readable storage media may be used. A computer readable storage medium may be, for example, but not limitation, an electronic, magnetic, optical, electromagnetic, infrared, or semiconductor system, apparatus, or device, or any suitable combination of the foregoing. More specific, but non-limiting, examples of the computer readable storage medium may include the following: a portable computer diskette, a hard disk, a random access memory (RAM), a read-only memory (ROM), an erasable programmable read-only memory (EPROM or Flash memory), a portable compact disc read-only memory (CD-ROM), a digital versatile disc (DVD), a Blu-ray disc, an optical storage device, a magnetic tape, a Bernoulli drive, a magnetic disk, a magnetic storage device, a punch card, integrated circuits, other digital processing apparatus memory devices, or any suitable combination of the foregoing, but would not include propagating signals. In the context of this disclosure, a computer readable storage medium may be any tangible medium that can contain or store a program for use by or in connection with an instruction execution system, apparatus, or device.

Computer program code for carrying out operations of one or more of the present inventions may be written in any combination of one or more programming languages, including an object-oriented programming language such as Java, Python, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. The remote computer may be connected to the user's computer through any type of network, including a local area network (LAN) or a wide area network (WAN), or the connection may be made to an exterior computer for example, through the Internet using an Internet Service Provider.

Reference throughout this disclosure to "one embodiment," "an embodiment," or similar language means that a particular feature, structure, or characteristic described in connection with the embodiment is included in at least one of the many possible embodiments of the present inventions. The terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

Furthermore, the described features, structures, or characteristics of one embodiment may be combined in any suitable manner in one or more other embodiments. In the following description, numerous specific details are provided, such as examples of programming, software modules, user selections, network transactions, database queries, database structures, hardware modules, hardware circuits, hardware chips, etc., to provide a thorough understanding of embodiments of the disclosure. Those of skill in the art having the benefit of this disclosure will understand that the inventions may be practiced without one or more of the specific details, or with other methods, components, materials, and so forth. In other instances, well-known structures, materials, or operations are not shown or described in detail to avoid obscuring aspects of the disclosure.

Aspects of the present disclosure are described below with reference to schematic flowchart diagrams and/or schematic block diagrams of methods, apparatuses, systems, and computer program products according to embodiments of the disclosure. It will be understood by those of skill in the art that each block of the schematic flowchart diagrams and/or schematic block diagrams, and combinations of blocks in the schematic flowchart diagrams and/or schematic block diagrams, may be implemented by computer program instructions. Such computer program instructions may be provided to a processor of a general-purpose computer, special purpose computer, or other programmable data processing apparatus to create a machine or device, such that the instructions, which execute via the processor of the computer or other programmable data processing apparatus, structurally configured to implement the functions/acts specified in the schematic flowchart diagrams and/or schematic block diagrams block or blocks. These computer program instructions also may be stored in a computer readable storage medium that can direct a computer, other programmable data processing apparatus, or other devices to function in a particular manner, such that the instructions stored in the computer readable storage medium produce an article of manufacture including instructions which implement the function/act specified in the schematic flowchart diagrams and/or schematic block diagrams block or blocks. The computer program instructions also may be loaded onto a computer, other programmable data processing apparatus, or other devices to cause a series of operational steps to be performed on the computer, other programmable apparatus or other devices to produce a computer implemented process such that the instructions that execute on the computer or other programmable apparatus provide processes for implementing the functions/acts specified in the flowchart and/or block diagram block or blocks.

The schematic flowchart diagrams and/or schematic block diagrams in the Figures illustrate the architecture, functionality, and/or operation of possible apparatuses, systems, methods, and computer program products according to various embodiments of the present inventions. In this regard, each block in the schematic flowchart diagrams and/or schematic block diagrams may represent a module, segment, or portion of code, which comprises one or more executable instructions for implementing the specified logical function(s).

It also should be noted that, in some possible embodiments, the functions noted in the block may occur out of the order noted in the figures. For example, two blocks shown in succession may, in fact, be executed substantially concurrently, or the blocks may sometimes be executed in the reverse order, depending upon the functionality involved. Other steps and methods may be conceived that are equivalent in function, logic, or effect to one or more blocks, or portions thereof, of the illustrated figures.

Although various arrow types and line types may be employed in the flowchart and/or block diagrams, they do not limit the scope of the corresponding embodiments. Indeed, some arrows or other connectors may be used to indicate only the logical flow of the depicted embodiment. For example, but not limitation, an arrow may indicate a waiting or monitoring period of unspecified duration between enumerated steps of the depicted embodiment. It will also be noted that each block of the block diagrams and/or flowchart diagrams, and combinations of blocks in the block diagrams and/or flowchart diagrams, may be implemented by special purpose hardware-based systems that perform the specified functions or acts, or combinations of special purpose hardware and computer instructions.

The description of elements in each Figure may refer to elements of proceeding Figures. Like numbers refer to like elements in all figures, including alternate embodiments of like elements. In some possible embodiments, the functions/actions/structures noted in the figures may occur out of the order noted in the block diagrams and/or operational illustrations. For example, two operations shown as occurring in succession, in fact, may be executed substantially concurrently or the operations may be executed in the reverse order, depending upon the functionality/acts/structure involved.

Turning now to several descriptions, with reference to Figures, of particular embodiments incorporating one or more aspects of the disclosed inventions, FIG. 1 illustrates one exemplary embodiment of an artificial lift system 100 with under pumping mitigation.

The illustrated system includes a sucker rod pump 102, that is connected to a sucker rod 104. The sucker rod 102 may be positioned within a tubing string (not illustrated) that is configured to be in fluid communication with a reservoir. The pump 102 and sucker rod 104 are positioned within a space that, in the illustrated example, is defined by the open are within a casing string 106 positioned within a subsurface wellbore.

In the illustrated example, pump 102 is positioned such that it may be stroked downwards and upwards within an annulus which, in the example of FIG. 1, corresponds to an interior space defined by the casing string. In the illustrated example, during such strokes, the pump 102 moves within a body of fluid having a fluid upper level 108. The fluid may take many forms and can be a fluid formed of a mixture of various hydrocarbons, water and/or any other fluid. The pump 102 may, during a single downwards and upwards stroke be fully or partially located within the fluid during the entirety of the stroke.

In the illustrated example, as the pump 102 strokes downwards within the fluid, a cavity within the pump will be filled with fluid. As the pump 102 strokes upward fluid within the pump is released into cavity and pumped upward and out of the wellbore.

Under desired, ideal, and unchanging conditions, the pumping capacity of the system will be aligned with the production rate of the formation associated with the wellbore such that the fluid level within the wellbore will remain relatively constant. Unfortunately, reservoir conditions, and thus the fluid levels within an annulus in which a sucker rod pump is positioned, are often not as desired, are not ideal, are not status, and are changing and dynamic. Under certain conditions, a change in the reservoir conditions can produce a situation where the formation production rate exceeds the pumping capacity of the system. This situation—sometimes referred to as "under pumping"—is undesirable because it can result in an increase in the fluid level within the well bore and, in particular, a situation where the fluid level within the wellbore can increase in an uncontrolled manner.

Such an increase in the fluid level is detrimental because, for example, it can decrease both the real-time production from the well and the long-term production from the well. It can also create a situation where the pressure within the well increases to a point where it can restrict or prevent the flow of fluids from the reservoir into the wellbore. If left unaddressed for a significant period of time, an under pumping condition can potentially cause the pressure in the wellbore to rise to a level where undesired stresses are placed on the reservoir and/or well equipment.

To minimize the potential for undesired conditions resulting from an under pumping situation, the exemplary system 100 of FIG. 1 is able to detect, alert and/or mitigate pumping conditions by: (i) detecting an under pumping condition through, for example, continuous monitoring of the annular fluid level; (ii) optionally providing notice concerning the detected condition and/or (iii) varying the pumping rate of the pump 102 to cause a decrease in the level of fluid within the wellbore and/or to reduce the rate at which the fluid level within the wellbore is increasing through, for example, automatically adjusting the speed at which the pump is operated in response to detected changing reservoir conditions. This automatic adjustment may be incremental and temporary. It may also be limited to adjustment up to a preset maximum speed.

In one exemplary embodiment, the exemplary system 100 includes an electronic control system 110 that includes a variable speed drive system for driving a variable speed motor 112 driving the crank of a beam pumping assembly 114. In such an embodiment, the variable speed drive system within the control system 110 may be configured to excite the variable speed motor 112 in such a manner that the rotational speed of the motor 112, and thus, the pumping speed of the beam pumping assembly 114 is varied.

The variable speed motor 112 and the variable speed drive may take different forms. In one exemplary embodiment, the variable speed motor 112 is a variable speed induction motor and the variable speed drive 110 within the control system varies the frequency of the electrical signals applied to the motor 112 so as to vary the rotational speed of the motor 112, and thus the pumping rate of the pump 102.

Alternate embodiment, however, are envisioned wherein the motor 112 and controller 110 are such that the motor does not operate over a range of continuously variable speeds, but rather operates at one of several fixed speed settings. Still alternate forms of motors (and suitably matched variable speed drives) are envisioned wherein the motor 112 takes the form of a standard induction motor, a squirrel cage induction motor, a permanent magnet motor, a permanent magnet DC motor, a switched reluctance motors, or any other suitable motor. Further various forms of variable speed drives can be used with the appropriate drive selected based on the motor to be used with the drive. The variable speed drive can, with respect to the rotating speed of the motor, be operated either as an open loop drive or a closed loop drive.

In the exemplary embodiment of FIG. 1, the controller 110 can, in addition to driving the variable speed motor 112, operate to detect an under pumping condition, provide notice upon the detection of such a condition, and—during operating periods where an under pumping condition has not been detected—attempt to mitigate the condition by adjusting the pumping rate of the system to a rate that exceeds a pre-determined maximum pumping rate used by the system during normal operation (which may be defined in terms of strokes per minute or Maximum Working Speed).

The maximum defined pumping speed (Maximum Working Speed) can be established in several ways. In accordance with one approach, Maximum Working Speed is defined by a user of the system during initial system configuration. The initial Maximum Working Speed value may be set based on a desire to prolong the life of the system since the speed at which a beam pumping unit is operated will impact the stresses imposed upon the unit during operation. Because of this, certain users will select a Maximum Working Speed value to optimize the useful life of the unit. While the Maximum Working Speed value will vary from artificial lift unit to unit, and from user to user, in certain embodiments, the Maximum Working Speed value will vary between 4 and 8 SPM. For embodiments using linear rod pumps, the Maximum Working Speed may be lower, and in the range of 2 to 4 SPM.

Figure 2A:
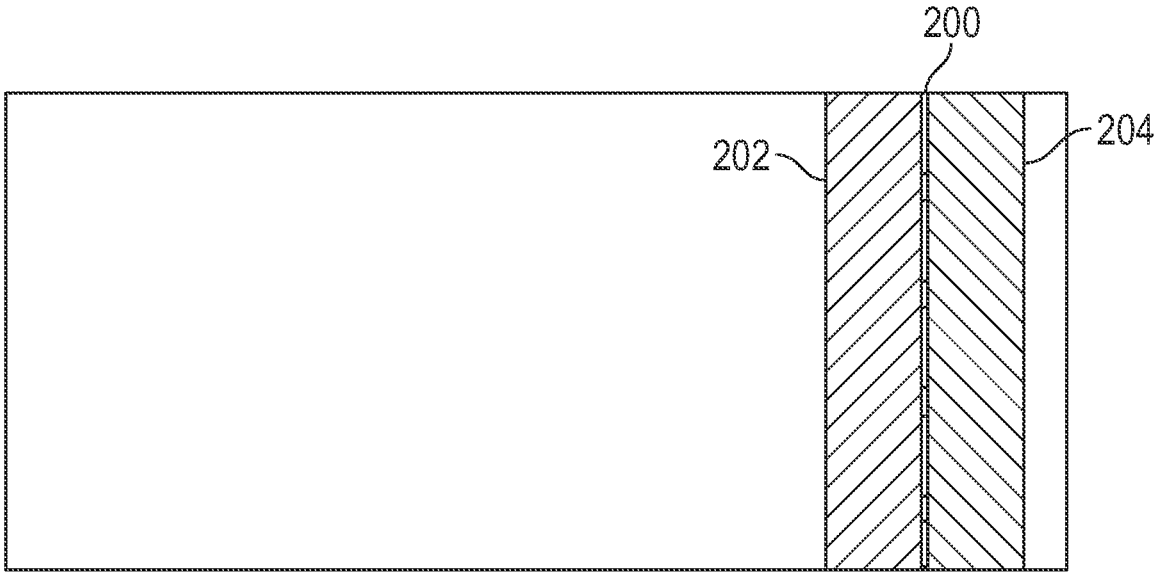
FIGS. 2A and 2B illustrate aspects of the operation of the system of FIG. 1 during normal operation.
Figure 2B:
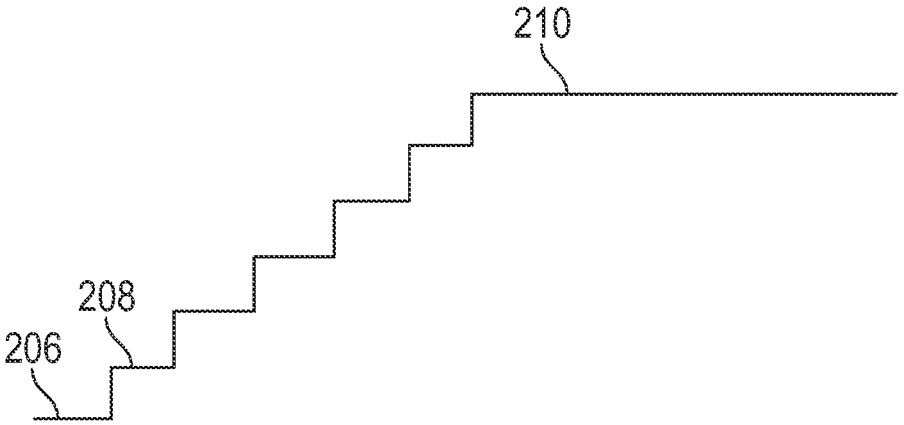

FIGS. 2A and 2B illustrate aspects of the operation of the system of FIG. 1 during normal operation.

Turning first to FIG. 2A, an ideal pumping card is illustrated that reflects a target desired fillage percentage 200 for the pump 102. In the example of FIG. 2A. the target desired fillage percentage 200 corresponds to a vertical line that extends across the ideal pump card. While the target desired fillage percentage 200 can be set at any suitable level, in the illustrated example, the percentage 200 is considered to be set at 90%.

It will be appreciated that the pump fillage percentage can be measured, calculated, or inferred in a variety of different ways. For example, sensors may be included within pump 102 for detecting the pump fillage level. Alternatively, various approaches can be used to calculate the pump fillage percentage. For example, known methods for calculating pump fillage, such as the method of ordering, the method of positions, and/or the method of loads could be used individually or collectively to generate pump fillage percentage. It will be understood that the system disclosed herein is not restricted to any specific approach for measuring or determining the pump fillage percentage.

FIG. 2A also depicts a dead band about the target fillage percentage 200 that extends from a lower boundary 202 to an upper boundary 204. In the illustrated example the upper and lower dead band boundaries are set to be a fixed distance from the target fillage percentage 200, such that, in the illustrated example, the lower boundary 202 corresponds to a fillage percentage of 85% and the upper boundary 204 corresponds to a fillage percentage of 95%.

In the example of FIGS. 1A, 2A and 2B, during normal operation the controller 110 will control the operating speed of the pump 102 based on a detected, calculated, or inferred pump fillage percentage such that the operating speed of the pump is—if possible—maintained within the dead band defined by the upper and lower fillage percentages 202 and 204. In accordance with this embodiment, the system 100 will be provided, generally at an initial configuration time, with various control parameters which may include: (a) a desired target fillage percentage 200; (b) a maximum pump speed; and (c) a desired pump speed change variable.

In such an embodiment, under normal operating conditions, the controller will, on a periodic basis, assess the detected, calculated, or inferred pump fillage value and, if the value is below the lower dead-band limit 202 cause the controller 110 to decrease the speed of the variable speed motor 112 to decrease the pumping speed of the pump 102. In embodiments where a desire pump speed change variable is provided the speed decrease will correspond to the provided variable. In the example provided above the speed decreases will—in general—continue for so long as the pump fillage value used by the controller 110 is below the lower dead band limit 202. In still alternate embodiments, operation of the system at pump fillage percentages below the lower dead band limit 202 (or very low pump fillage percentage level) may result in the controller 110 halting operation of the pump 102 for a defined or variable period of time.

During normal operation of the system 100, detection or calculation or inference of a pump fillage level above the upper dead band 204 will result in the controller 110 increasing the pumping rate (potentially be a defined increase amount) during intervals where such a pump fillage level is detected (or calculated or inferred). However, during normal operation, the speed of the pump will not be increased above a maximum pumping rate (e.g., as defined by a user or set by the controller 110) and, absent entry into a under pumping mitigation condition as described below, the controller 110 will operate the motor 112 at the defined maximum operating speed. This operation is illustrated generally in FIG. 2B.

For purposes of FIG. 2B, it is assumed that the system is initially operating at a pumping rate corresponding to the rate line 206. The pumping rate at this point may be defined using any suitable variables. In one embodiment the pumping rate is defined in terms of the average strokes per minute of the unit or SPM. It will be appreciated, however, that the pumping rate could be defined in other ways such as, for example, the rotational speed of the motor 110 and/or the frequency of the electrical excitation signals provided to the motor 112.

In the example of FIG. 2B, it is assumed that during operation of the system at the pumping speed associated with condition 206, the pump fillage value used by the controller 110 is determined to be over the upper dead band limit and that, as a result, the pumping rate is increased to a level reflected by condition 208.

In the example it is presumed that additional pump fillage values are provided indicating that the pump fillage percentage is above the upper dead band limit 208, such that the controller 110 will continue to increase the pumping rate until the maximum pumping rate (which could be designated Maximum Working Speed) is reached at condition 210. At that point, the system 100 will not further increase the pumping rate but will maintain the pumping rate at the maximum pumping rate (Maximum Working Speed).

In certain situations, operation of the pump 102 at an elevated pumping rate (for example Maximum Working Speed) will result in the pump fillage percentage dropping to within the dead band.

In other situations, however, operation of the pump 102 at an elevated (Maximum Working Speed) rate will result in the pump 102 extracting fluid from the well bore at—or below—the rate that fluid is flowing from the reservoir into the wellbore, such that continued operation of the pump at the Maximum Working Speed rate will either maintain the level of fluid within the wellbore at a relatively constant level such that the pump fillage level remains above the upper pump percentage dead band limit 204 or such that the level of fluid within the wellbore begins to increase. Such a condition, which corresponds to an under pumping condition as described above, is depicted in FIG. 3, where the fluid level 130 is shown as being above the fluid level 108 depicted in FIG. 1.

Figure 3:
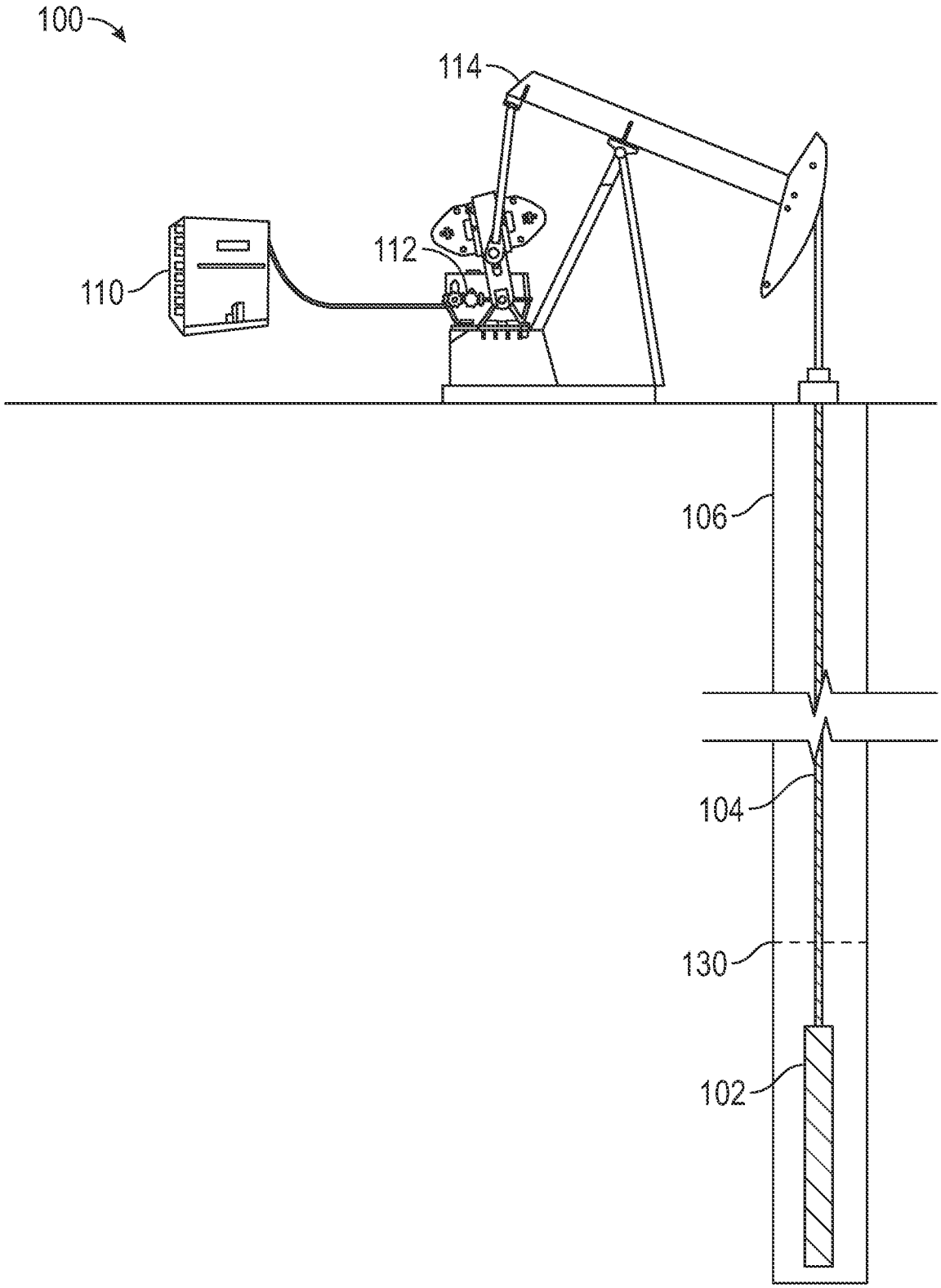
FIG. 3 illustrates the system of FIG. 1 in an exemplary under pumping condition.

Under the under pumping condition depicted in FIG. 3, the exemplary system 100 disclosed herein, is capable of detecting the existence of an under pumping condition, providing a notification of such a condition and, optionally, initiating an under pumping mitigation process under which the system 100 operates the pump 102 at a rate above the maximum pumping rate set for normal operation of the system. An exemplary implementation of this process is depicted in FIGS. 4, 5 and 6.

Figure 4:
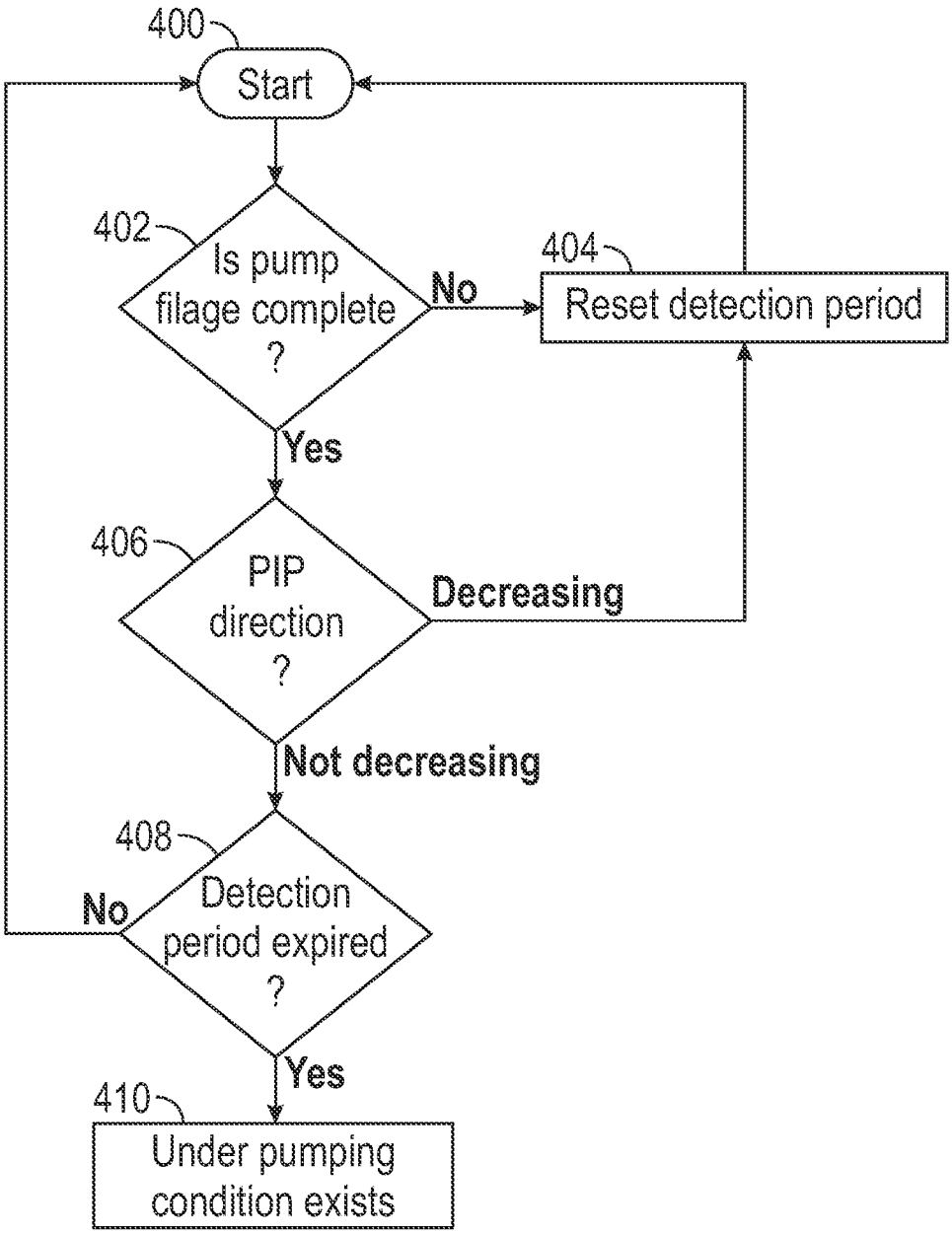
FIG. 4 illustrates an exemplary process for detecting an under pumping condition is illustrated.
Figure 5:
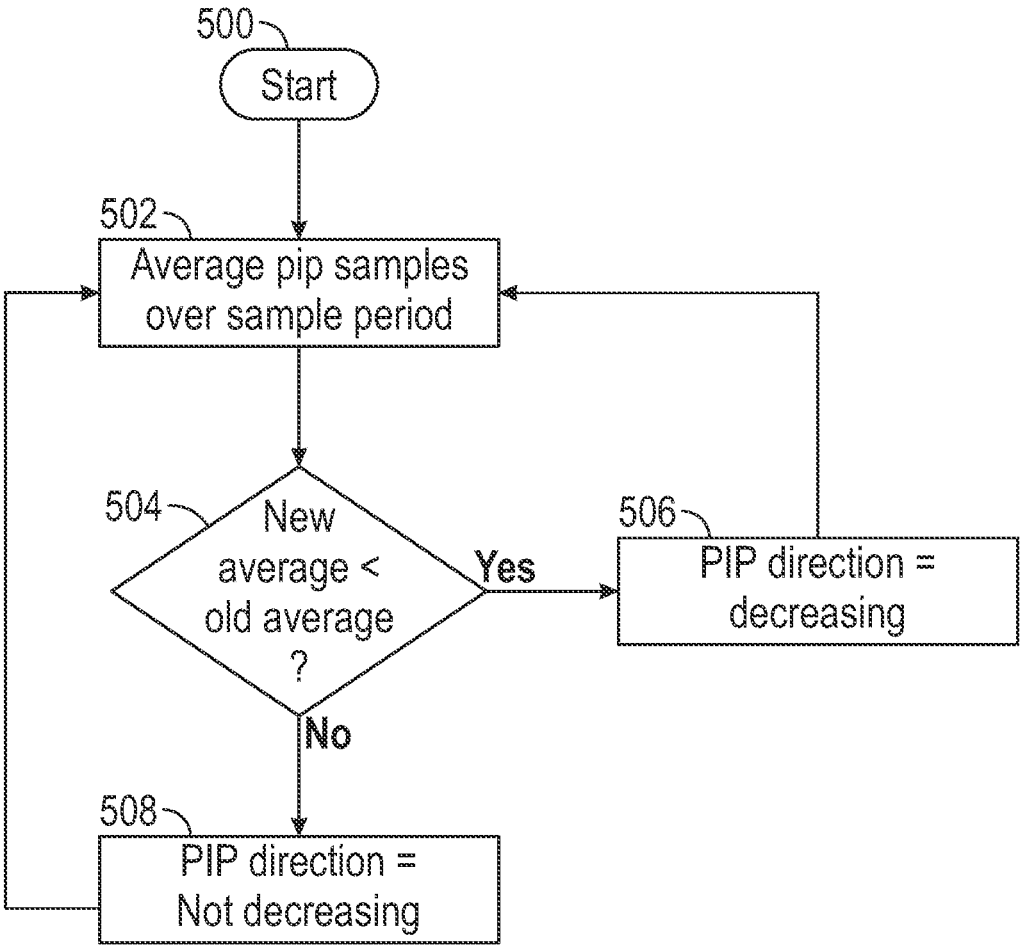
FIG. 5 illustrates an exemplary process that may be used to determine whether the fluid level is decreasing or not based on pump intake pressure (or PIP) values.
Figure 6:
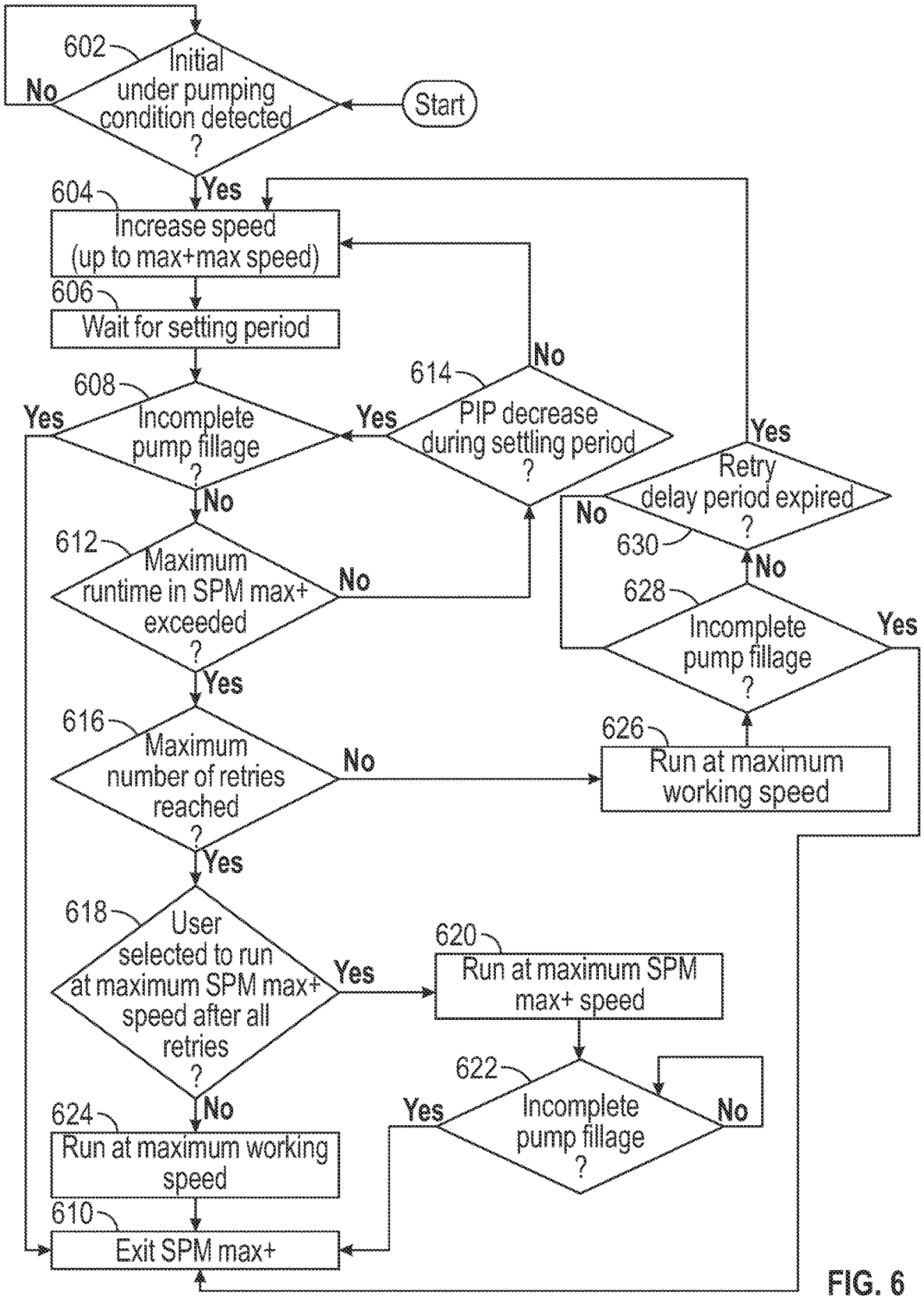
FIG. 6 illustrates an exemplary, self-initiated, under pumping mitigation process.

It will be appreciated that the process depicted in FIGS. 4, 5, and 6 can be implanted through appropriate programming of controller 110 and/or through use of multiple discrete programed or hard-wired controllers in place of a single controller 110.

Turning first to FIG. 4 a process for detecting an under pumping condition is illustrated. The process begins at step 400. The process may be continuously run during normal operation of the system 100 or may be initiated only after the system has reached a point where it is operating at the maximum pump operating speed (Maximum Working Speed). In the example of FIG. 4, the process will be initiated once the operating speed of the pump has reached Maximum Working Speed and the process will repeat regularly upon each expiration of an under pumping detection period. The under pumping detection period can be a period corresponding to a particular time period or a period defined by some other variable (such as a given number of pump strokes).

Once the under pumping detection process is initiated, the system will proceed to step 402 where it will determine whether the pump fillage percentage reflects complete fillage of the pump. The manner in which complete fillage is determined can vary, but in one exemplary embodiment, complete fillage is determined by comparing a calculated pump fillage percentage with a given fillage percentage level and concluding that the pump is completely filled if the pump fillage percentage is equal to or above the given fillage percentage level. In a still further example, the given fillage percentage level used to determine complete fillage level is the fillage level associated with the upper level of the dead band used for pump speed control during normal operation as described generally with respect to FIGS. 2A and 2B. Thus, in this specific example, complete pump fillage will be determined to exist if the determined pump fillage percentage is greater than the upper dead band limit 204.

If the system determines at 402 that the pump fillage percentage does not reflect a completely full pump, the system will reset a complete fillage detection period at step 404 (e.g., by resetting a timer if the period is defined by time or a stroke counter if the period is determined by strokes), return to step 400, and continue operating in the normal mode of operation.

In the event that the system determines at step 402 that a complete fillage condition exists, the system will them proceed to step 406 where it will determine whether the fluid level within the wellbore is decreasing. The determination of whether the fluid level within the wellbore is decreasing can be made in a variety of different ways. For example, in the embodiment of FIG. 4, this is done by considering whether the pump intake pressure (or PIP) for pump 102 is decreasing as the PIP will generally vary with the level of fluid within the wellbore. It will be appreciated, however, that alternate approaches can be used to determine the level of fluid within the wellbore including, for example, direct detection of fluid levels, sonic or ultrasonic detection of fluid levels, or any other suitable method or process for sensing, detecting, measuring, calculating, or inferring the level of fluid within the wellbore.

In accordance with the exemplary embodiment of FIG. 4, the determinant of whether the fluid level within the wellbore is decreasing is made based on an analysis of the pump intake pressure (sometimes referred to as "PIP"). FIG. 5 illustrates one process that may be used to determine whether the fluid level is decreasing or not based on pump intake pressure (or PIP) values.

In the exemplary process of FIG. 5, the system starts at step 500 and then proceeds to step 502 where it calculates a running average PIP value based on a window of past PIP values. The window used to calculate the average PIP value can vary. In the example of FIG. 5, the window consists of the last 10 measured or determined PIP values.

Once the running average PIP value is determined at step 502 the system will proceed to step 504 where it determines the current running average PIP value to the prior running average PIP value. If the current running average PIP value is less than the prior running average PIP value, the system will conclude that the PIP value—and by inference the fluid level within the wellbore—is decreasing and, potentially set a variable to that effect at step 506 where it will return to step 502.

If, however, the system determines at step 502 that the current running average PIP value is the same as or greater than the prior average PIP value, the system will determine that the PIP value—and by inference the fluid level within the wellbore—is NOT DECREASING and will move to step 508 where it will potentially, set a variable to that effect. The system will then return to step 502 and the process will repeat.

Returning to FIG. 4, if the system determines in step 406 that the fluid level in the wellbore is NOT DECREASING (e.g., by determining that the PIP is NOT DECREASING through use of the method illustrated in FIG. 5) the system will proceed to step 408 to determine whether the under pumping detection period has expired.

If the system determines in step 408 that the under pumping detection period has expired—meaning that the pump fillage condition has reflected a completely filled pump and the fluid level has exhibited a NOT DECREASING condition over a duration of at least one under pumping detection period, the system will proceed to step 410 where it will conclude that an under pumping condition exists and will, potentially, set a variable to that effect.

If the system determines at step 408 that the under pumping detection period has not expired, it will return to step 400 and repeat the process.

Upon the detection of an under-pumping condition at step 410 the exemplary system can implement one or more notice and/or remediation processes.

For example, in one embodiment, upon the detection of an under pumping condition the controller 110 can exhibit an audible and/or visual notice (e.g., a flashing light and/or a chirping sound) to inform a user of the system that an under pumping condition exists. Alternatively, or additionally, the system 100 could send an electronic notice to a user in the form of a text message or an email. A user who receives a notice along the lines described above could then review the operating condition of the system and adjust the operating parameters of the system to address the under pumping condition. Alternatively, a user who receives such a notice could take steps to cause the system 100 to initiate an under pumping mitigation operation.

In addition to, or as an alternative to, the provision of a notice of under pumping, the controller 110 can store and maintain a record of the number of times, and/or the conditions under which the under pumping mitigation process was activated. Such a record can be used by a production team member to evaluate pump and/or reservoir performance.

In one exemplary embodiment the system 100 can be configurated to self-initiate an under pumping mitigation process once an under pumping condition is detected. One exemplary under pumping process is shown in FIG. 6.

Turning to FIG. 6, the system 100 will begin the under pumping mitigation process at step 600, either automatically or in response to user action. Upon process initiation, the system 100 will determine whether an under pumping condition exists by, for example, implantation of the process described above in connection with FIG. 5.

If the system determines at step 602 that there is no under pumping condition, the system will and return to step 600 where the described process can be repeated (perhaps with after a defined delay period has passed).

If the system determines at step 602 that an under pumping condition exists, the system will—in the illustrated example—proceed to step 604 where the pumping speed of the pump will be increased. The speed of the pump can be increased at step 604 by a fixed or variable amount. In embodiments where a defined pumping rate increase is used during normal operation the pumping rate increase at step 604 can be the same or different from the rate increase used during normal operation.

Once the pumping speed is increased in step 604, the system will proceed to step 606 where it will wait until a settling period has passed before taking further action with respect to the detected under pumping condition. The settling period in 606 can be determined through any suitable parameter such as, for example, a time-based parameter or a stroke-based parameter. The settling period in step 606 can be set as either a fixed parameter or a parameter that varies.

For example, embodiments are envisioned wherein the settling period is a fixed parameter that a user can set during initial configuration or operation of the system 100.

As another example, embodiments are envisioned wherein the settling period is variable and the parameter defining the settling period is adjusted based on, for example, the current pumping speed, the extent of prior determinations of an under pumping condition, a detected rate of change in fluid level (or PIP), or other detected values or calculated conditions.

After the settling period associated with step 606 passes, the system will proceed to step 608 where it will determine whether an incomplete pump fillage percentage is detected. This can be accomplished in a variety of ways including one of the processes discussed above. In example, incomplete fillage can be determined in the event that the pump fillage percentage is within a normal operating dead band as described above in connection with FIGS. 2A and 2B. In an alternate embodiment, incomplete fillage can be determined in step 608 if the pump fillage percentage is below a lower dead band limit (or below a target fillage value). In yet another alternate embodiment, incomplete fillage can be determined if the pump fillage percentage is below 100%. In still alternate embodiments, incomplete fillage can be determined if the pump fillage level is below a fillage percentage level different from any pump fillage levels used to control the system during normal operation.

In the example of FIG. 6, if the system determines at step 608 that an incomplete pump fillage condition exists, it will exit the under pumping mitigation mode and return to the normal operating mode at 610. If, however, the system determines at step 608 that no incomplete pump fillage conditions exists, it will—in the illustrated example—proceed to step 612.

In the illustrated example, at step 612, the system 100 will determine whether the period in which the system has been operating in the under pumping mitigation mode is greater than a preset maximum period value. If the system determines that the maximum period value has not been exceeded, it will proceed to step 614 where it will determine whether the fluid level in the wellbore (or the PIP) has decreased over the settling period. If the system controller 110 determines that such a decrease has occurred, it will return to step 608 without increasing the pump speed.

, however, the system controller 110 determines at step 614 that the fluid level in the wellbore (or the PIP) has NOT decreased, it will proceed to step 604, where the pump speed will be increased and the processes repeated along the lines discussed above.

In the illustrated example, if the system determines at step 612 that the maximum under pump mitigation period has been exceeded, it will proceed to 616 where it will determine whether the maximum number of mitigation period retries has been exceeded. This determination is optional and can be used to limit the extent to which the system 100 is permitted to operate in an under pumping mitigation mode. In embodiments where such a determination is made, the system can—once the maximum number of retries has been completed—proceed to determine whether a user has configured the system to operate in a specific manner if a maximum number of retries has been attempted at step 618.

If a user has configured the system to operate at a set maximum—under pumping mitigation speed—the system can then proceed to steps 620 and 622, wherein the system will operate the system at a designated under pumping maximum pump rate (through a setting made at 620) until an incomplete fillage condition is detected at step 622. If a user has not so configured the system, the system can proceed to step 624, where the pump speed is set to the normal operating mode maximum pump speed (e.g., Maximum Working Speed) and to step 610 where it will exit the under pumping mitigation mode.

If the system determines at step 616 that the maximum number of mitigation period retries has NOT been exceeded, the system will proceed to step 626 where it will run the pump 102 at the maximum working speed at step 626, while checking for incomplete pump fillage at step 628 over a retry delay period through a check made at step 630. As reflected in the example, once the retry delay period has been determined to have been expired at step 630, the system will return to step 604. As reflected in the example, if an incomplete pump fillage condition is detected at step 628, the system will proceed to exit the system at step 610.

It will be appreciated that the artificial lift system depicted in FIG. 1 is exemplary and presented in simplified form to permit efficient disclosure of the system and methods discussed herein. Those of ordinary skill in the art having the benefit of this disclosure will understand that physical embodiments of the disclosed apparatus and methods, additional or alternative structures could be used to form the artificial lift system. One such exemplary system is shown in FIG. 7.

Figure 7:
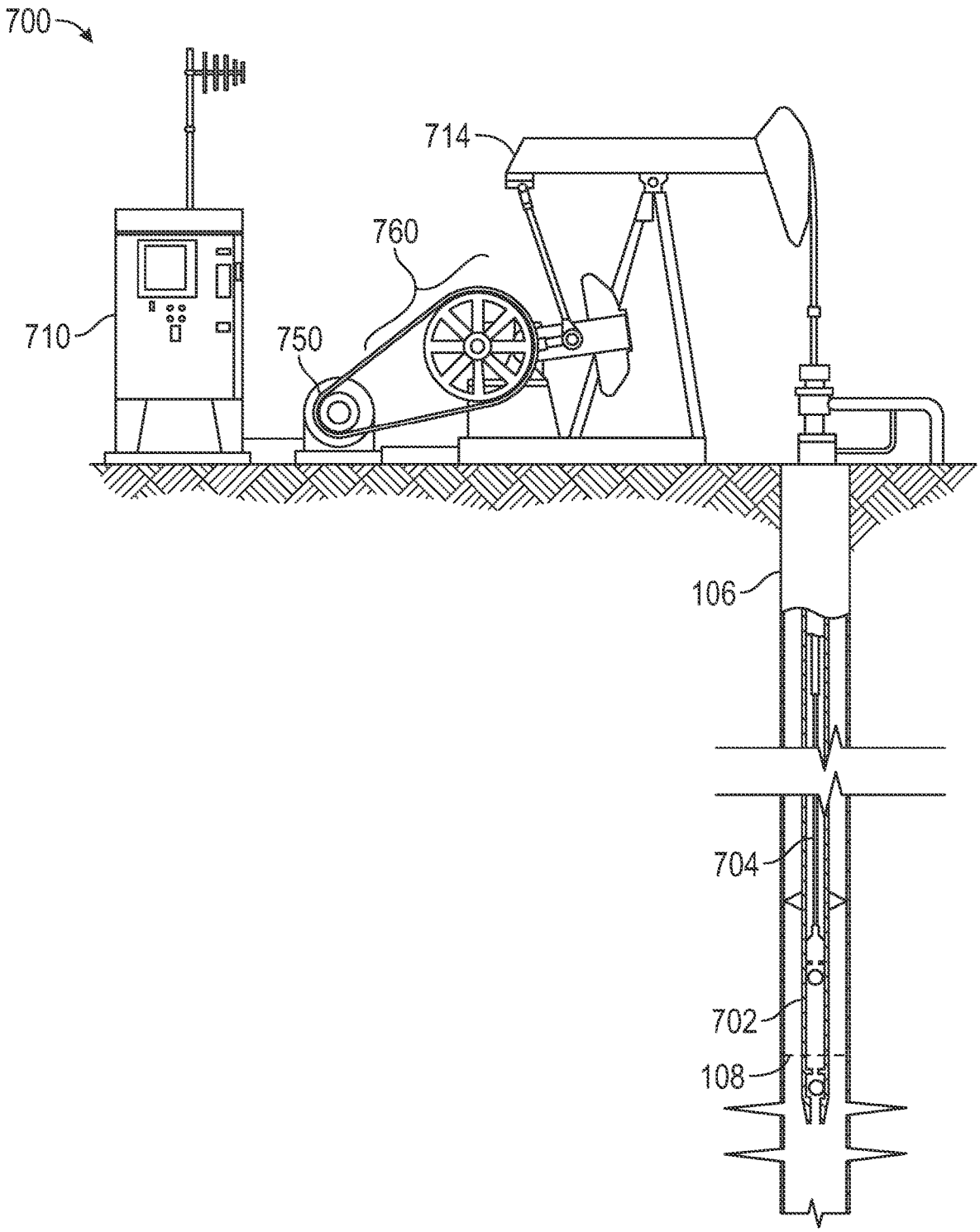
FIG. 7 illustrates an alternative exemplary artificial lift system that may be used to implement the under pumping mitigation functionality described in this disclosure.

FIG. 7 illustrates an alternative exemplary artificial lift system 700 that may be used to implement the under pumping mitigation functionality described in this disclosure. Like the embodiment of FIG. 1, the system 700 includes a controller 710 and a beam pumping unit 714 that includes a pump 702 and a rod 704. In the example of FIG. 7, the pump 702 and rod 704 are positioned within an annulus defined, in the example, by a casing string 106. As with the example of FIG. 1. a fluid, having a fluid level 108, resides in the annulus.

Unlike the exemplary system of FIG. 1, the system 700 of FIG. 7 includes a prime mover 750 that is coupled to the beam pumping unit through a mechanical coupling 760. In the illustrated example, the prime mover 750, operating under the control of the controller 710 and through the mechanical coupling 760, operate the beam pumping unit 714 such the pump 702 can operate at different pumping speeds to implement the under pumping mitigation functionality described herein.

In the example of FIG. 7, the prime mover 750 can take many different forms. Exemplary embodiments are envisioned where the prime mover takes the form of an electric, gas or hydraulic motor. In certain embodiments, the prime mover 750 is such that it can be controlled by the controller 710 to operate across a range of various speeds. Alternate embodiments are envisioned wherein the prime mover 750 is capable of being operated by the controller 710 at only certain defined speeds. Still alternate embodiments are envisioned wherein the prime move 750 is capable of operating at only a single speed, or across a nor speed range, and where the mechanical coupling 760 is adjusted during operation to vary the pumping speed of the pump 102.

In the example of FIG. 7, the mechanical coupling 760 can likewise take different forms. In one embodiment, the mechanical coupling 760 can include a gear reducer, with sheaves and belts. In an alternate embodiment, the mechanical coupling 760 can include a transmission-like element under the control of the controller 710 such that adjustment of the transmission element can adjust the operating speed of the pump 102. In still further embodiments, the prime mover 750 can take the form of a permanent magnet motor that is mounted directly onto a high speed shaft/gear of a gear reducer within the mechanical coupling 760. In such an embodiment, the mechanical coupling 760 need not include any sheaves or belts.

I will be appreciated form consideration of FIGS. 1 and FIG. 7 that the teachings of the present disclosure are not limited to any specific artificial lift system arrangements.

In the exemplary examples provided above, the described artificial lift system 100 includes a sucker rod pump 102 that stroked by a beam pumping unit that is driven by a variable speed motor 112 driven by a variable speed drive 100 (or the alternate arrangement described in connection with FIG. 7). It will be appreciated that the operating processes described here is not limited to such an embodiment and that one could utilize the teachings of this disclosure in connection with an artificial lift system using different forms of pumping apparatus and/or different apparatus for driving such pumps.

For example, the pumping apparatus can be any form of pumping apparatus that can be subject to varying fillage percentage levels.

Additionally, the apparatus driving the pump need not be a variable speed motor driven by a variable speed drive. Any suitable driving apparatus (or prime mover) can be used and embodiments are envisioned wherein the driving apparatus (or prime mover) takes the form of a gas engine, a diesel engine, or a pneumatically or hydraulicly driven apparatus. In certain alternate embodiments, the rod driving the pump may be integrated into the prime mover such that no separate driving apparatus is required. For example, the rod may be threaded and form the stator of an inside out electric motor having a rotor with a threaded interior bore that mates with the threaded exterior of the rod, such that activation of the motor will cause the stator to rotate (and cause the rod to move up or down).

In addition, the present disclosure can be implemented using artificial systems that do not involve beam pumping units. For example, linear pumping units can be utilized without departing from the teachings of this disclosure.

Other and further embodiments utilizing one or more aspects of the inventions described above can be devised without departing from the spirit of Applicant's invention. Further, the various methods and embodiments of the methods of manufacture and assembly of the system, as well as location specifications, can be included in combination with each other to produce variations of the disclosed methods and embodiments. Discussion of singular elements can include plural elements and vice-versa.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The inventions have been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicants, but rather, in conformity with the patent laws, Applicants intend to protect fully all such modifications and improvements that come within the scope or range of equivalent of the following claims.

What is claimed is:

1. An artificial lift system with under pumping mitigation comprising:

a sucker rod pump connected to a sucker rod, the sucker rod pump being positioned so that it may be stroked downwards and upwards within an annulus;

a variable speed motor coupled to drive the sucker rod pump such that it is stroked upwards and downwards by action of the motor;

a variable speed drive configured to excite the variable speed motor in such a manner that the rotational speed of the motor, and thus, the pumping speed of the sucker rod pump is varied;

a controller configured to:

determine the fillage level of the pump;

determine whether the fillage level of the pump is equal to or above a pre-determined fillage level;

in the event that the fillage level of the pump is determined to be equal to or above the determined fill level, determine whether the fluid level in the annulus is decreasing;

in the event that the fluid level in annulus is determined to be not decreasing, determine whether the determined conditions of: (a) a pump fillage level equal to or above the predetermined fillage level and (b) fluid level in the annulus that is not decreasing have co-existed for a period in excess of a predetermined duration; and in the event that the conditions of: (a) a pump fillage level equal to or above the predetermined fillage level and (b) fluid level in the annulus that is not decreasing have co-existed for a period in excess of the predetermined duration, controlling the variable speed drive to increase the speed of variable speed motor and, thus, the pumping rate of the sucker rod pump wherein the controller determines whether the fluid level in the annulus is decreasing by comparing a current running average of pump inlet pressure with a prior running average of the pump inlet pressure.

2. The artificial lift system of claim 1 further including a sensor for providing an output signal corresponding to the pump inlet pressure, wherein output signal is provided to the controller.

3. The artificial lift system of claim 1 wherein the variable speed motor is a variable speed induction motor, and the variable speed drive varies the frequency of the electrical signals applied to the induction motor so as to vary the rotational speed of the motor.

4. The artificial lift system of claim 1 wherein the variable speed motor and the variable speed controller are such that the motor operates at one of several fixed speed settings.

5. The artificial lift system of claim 1 wherein the controller is further configured to: (a) initiate a settling period upon the increase of the speed of the variable speed motor; (b) determine the pump fillage level upon the expiration of the settling period; and (c) controlling the variable speed drive to further increase the speed of variable speed motor and, thus, the pumping rate of the sucker rod pump, if it is determined that the pump fillage level detected after the expiration of the settling period is below a threshold level.

6. The artificial lift system of claim 1, further comprising a beam pumping assembly including a crank and a sucker pump rod, wherein the variable speed motor is coupled to the sucker rod pump through the crank and the sucker pump rod.

7. The artificial lift system of claim 1 wherein the controller is configured to determine the pump fillage level through one or more of: the method of ordering, the method of positions, and/or the method of loads.

8. A method of operating pump positioned within a wellbore to detect and mitigate under pumping conditions, the method comprising the steps of:

(a) determining the fillage level of the pump;

(b) determining whether the pump fillage level is equal to or above a pre-determined fillage level;

(c) determining whether the fluid level in the wellbore is decreasing; and (d) increasing the pump rate of the pump if: (i) the pump fillage level is determined to be equal to or above the predetermined fillage level and (ii) the fluid level in the wellbore is determined to be not decreasing; wherein the step of determining whether the fluid level in the wellbore is decreasing includes steps of:

(1) determining a first average pump intake pressure over a first window of pump intake pressures, wherein the first window corresponds to a first time period; and (2) determining a second average pump intake pressure over a second window of pump intake pressures, wherein the second window corresponds to a second time period, and wherein the second period of time follows the first period of time; and (3) determining that the fluid in the wellbore is not decreasing if the second average pump intake pressure not less than the first average intake pressure.

9. The method of claim 8 wherein the step of determining the fillage level of the pump comprises the practice of at least one of: the method of ordering, the method of positions, or the method of loads with respect to a sucker rod pump.

10. The method of claim 8 further including the steps of, prior to the step (c) of determining whether the fluid level in the wellbore is decreasing:

(A) determining whether the pump fillage level is between a predetermined minimum fillage level and maximum fillage level;

(B) increasing the pump rate of the pump if the pump fillage level is above the maximum fillage level;

(C) repeating steps (A) and (B) until the pump rate reaches a maximum working pump rate; and (D) proceeding to determine whether the fluid level in the wellbore is decreasing only after the pump rate has reached the maximum working pump rate.

11. The method of claim 8 further including the steps of:

(e) waiting a settling period after step (d);

(f) determining the fillage level of the pump upon the expiration of the settling period;

(g) repeating steps (b)-(d).

12. The method of claim 11 wherein step (b) includes the step of determining whether the fillage level of the pump is 100%.

13. A processor-readable storage medium, the medium storing processor readable instructions which cause a variable speed drive controller to perform operations for detecting and mitigating an under pumping conditions, the operations comprising:

14.1 determining the fillage level of the pump;

14.2 determining whether the pump fillage level is equal to or above a pre-determined fillage level;

14.3 determining whether the fluid level in the wellbore is decreasing; and 14.4 increasing the pump rate of the pump if: (i) the pump fillage level is determined to be equal to or above the predetermined fillage level and (ii) the fluid level in the wellbore is determined to be not decreasing and, wherein determining whether the fluid level in the wellbore is decreasing involves the steps of:

determining a first average pump intake pressure over a first window of sensed pump intake pressures, wherein the first window corresponds to a first time period; and determining a second average pump intake pressure over a second window of sensed pump intake pressures, wherein the second window corresponds to a second time period, and wherein the second period of time follows the first period of time; and determining that the fluid in the wellbore is not decreasing if the second average pump intake pressure not less than the first average intake pressure.

14. The processor-readable storage medium of claim 13 wherein the determining of the fillage level of the pump comprises the practice of at least one of: the method of ordering, the method of positions, or the method of loads with respect to a sucker rod pump.

15. The processor-readable storage medium of claim 13 wherein the instructions further cause the processor to implement the steps of, prior to step 14.3 of determining whether the fluid level in the wellbore is decreasing:

17.1 determining whether the pump fillage level is between a predetermined minimum fillage level and maximum fillage level;

17.2 increasing the pump rate of the pump if the pump fillage level is above the maximum fillage level; and 17.3 repeating steps 17.1 and 17.2 until the pump rate reaches a maximum working pump rate; and 17.4 proceeding to determine whether the fluid level in the wellbore is decreasing only after the pump rate has reached the maximum working pump rate.

16. The processor-readable storage medium of claim 13 wherein the instructions further cause the processor to implement the steps of:

18.1 waiting a settling period after step 14.4;

18.2 determining the fillage level of the pump upon the expiration of the settling period; and 18.3 repeating steps 14.2-14.4.

17. The processor-readable storage medium of claim 13 in combination with a controller coupled to a variable speed motor drive.

18. The processor-readable storage medium of claim 17 in combination with:

a variable speed motor electrically connected to the variable speed drive;

a beam pumping assembly having a crank, the crank being driven by the variable speed motor;

a sucker rod coupled to the crank; and a sucker rod pump coupled to the sucker rod.

* * * * *